US005944499A

United States Patent [19]

Morita

[11] Patent Number: 5,944,499

[45] Date of Patent: Aug. 31, 1999

[54] ROTOR-TYPE PUMP HAVING A COMMUNICATION PASSAGE INTERCONNECTING WORKING-FLUID CHAMBERS

[75] Inventor: Shoji Morita, Kanagawa, Japan

[73] Assignee: Unisia Jecs Corporation, Atsugi, Japan

[21] Appl. No.: 08/861,535

[22] Filed: May 22, 1997

[30] Foreign Application Priority Data

May 31, 1996 [JP] Japan ..... 8-137330
May 27, 1996 [JP] Japan ..... 8-131454

[51] Int. Cl.[6] ..... F04C 2/22; F04C 15/00

[52] U.S. Cl. ..... 418/8; 418/61.2; 418/75

[58] Field of Search ..... 418/8, 75, 78, 418/61.2

[56] References Cited

U.S. PATENT DOCUMENTS

| | | | |
|---|---|---|---|
| 3,108,578 | 10/1963 | Scherenberg | 418/61.2 |
| 3,260,247 | 7/1966 | Gassmann et al. | 418/61.2 |
| 4,141,126 | 2/1979 | Okada | 418/61.2 |
| 4,150,926 | 4/1979 | Eiermann | 418/75 |
| 4,507,066 | 3/1985 | Duffy | 418/61.2 |
| 4,969,809 | 11/1990 | Eiermann et al. | 418/91 |
| 5,114,325 | 5/1992 | Morita | 418/171 |
| 5,391,067 | 2/1995 | Saunders | 418/60 |
| 5,410,998 | 5/1995 | Paul et al. | 418/61.2 |
| 5,443,375 | 8/1995 | Cureton et al. | 418/61.3 |
| 5,769,619 | 6/1998 | Crvelin et al. | 418/61.2 |

FOREIGN PATENT DOCUMENTS

| | | | |
|---|---|---|---|
| 0 787 902 | 8/1997 | European Pat. Off. . | |
| 1547670 | 10/1968 | France . | |
| 3113233 | 12/1982 | Germany | 418/75 |
| 64-15726 | 1/1989 | Japan . | |
| 8-42462 | 2/1996 | Japan . | |
| 94/17284 | 8/1994 | WIPO . | |

*Primary Examiner*—John J. Vrablik
*Attorney, Agent, or Firm*—Foley & Lardner

[57] ABSTRACT

A rotor-type pump comprises a housing having a trochoidal curved surface and an intake port and a discharge port. A drive shaft is mounted rotatably about a first axis in the housing. A rotor having a second axis eccentric to the first axis is rotatably mounted to the drive shaft. The rotor cooperates with the trochoidal curved surface. A plurality of working-fluid chambers are defined by the trochoidal curved surface and an outer peripheral surface of the rotor and variable in volume as the rotor rotates. The intake port is open into one chamber of the chambers and the discharge port is open into another chamber thereof. A communication passage fluidly interconnects at least adjacent two of the chambers. A rotor control mechanism is provided for controlling the rotor to move along the trochoidal curved surface with a predetermined clearance therebetween upon rotation of the rotor.

33 Claims, 14 Drawing Sheets

ROTOR-TYPE PUMP HAVING A COMMUNICATION PASSAGE INTERCONNECTING WORKING-FLUID CHAMBERS

BACKGROUND OF THE INVENTION

1. Field of the Invention

The present invention relates to a rotor-type pump suitable for a hydraulic pump producing the oil pressure which is required to circulate lubricant to automobile parts such as various moving engine parts or to deliver working fluid to power steering.

2. Description of the Related Art

Various types of oil pumps are generally known, which are used in pressure-feed systems, for delivering lubricant to an internal combustion engine or working fluid to a power steering system. Among them, for instance, there are gear pumps, plunger pumps.

In addition, in order to provide a hydraulic pump having higher performance, it is desired to apply a basic construction of a Wankel engine, namely, four-stroke cycle rotary piston engine, to hydraulic pumps. The construction and operation of the Wankel engine is explained hereinafter. The Wankel engine typically has a rotor housing having an inner peri-trochoidal curved surface, spaced side housings enclosing and sealing the housing, a drive shaft or crankshaft with a rotor journal eccentric to a center axis of the drive shaft. A generally triangular rotor is rotatably eccentrically disposed in the rotor housing and has three rotor lobes or apexes which are circumferentially equi-distantly spaced to each other and slides on the inner peri-trochoidal curved surface of the housing as the rotor rotates on the rotor journal. A stationary gear is secured to one of the side housings and has a bearing supporting one end of the drive shaft. A rotor internal gear is mounted in the rotor. The rotor fits on the eccentric rotor journal so that the rotor internal gear meshes with the stationary gear. The rotor is guided by the stationary gear and rotates around the stationary gear. Apex seals on the three lobes are in contact with and tightly fit against the inner peri-trochoidal curved surface to provide a tight seal. Thus, three separate chambers are defined by the inner peri-trochoidal curved surface, respective adjacent two of the rotor lobes and outer peripheral surface portions extending between the respective adjacent two of the rotor lobes. When the rotor rotates around the stationary gear of the side housing, the chambers increase and decrease in volume. An intake port and an exhaust port are provided in the rotor housing or the side housing in parallel to each other. A pair of spark plugs are so disposed in the housing as to face the two ports.

In case of a well-known one-rotor Wankel engine, the gear ratio between the rotor internal gear and the stationary gear is set at 1:3 so that the drive shaft rotates three times every revolution of the rotor. Thus, there are four stages, namely, induction stroke, compression stroke, power stroke and exhaust stroke, with respect to each of the chambers defined by the inner peri-trochoidal curved surface and the outer peripheral surface of the rotor during one revolution of the rotor. Specifically, when the rotor rotates after one of the rotor lobes has cleared the intake port, the chamber between the one lobe (leading lobe), the adjacent lobe (trailing lobe) and the housing begins to increase to produce a partial vacuum, causing air-fuel mixture to flow into the rotor housing. With a further rotation of the rotor, the chamber continues to increase in volume. When the rotor reaches a point wherein the trailing lobe passes the intake port, the air-fuel mixture is sealed between the leading and trailing lobes. As the rotor further rotates, the chamber decreases in volume to cause the mixture therein to be compressed. When the compression of the mixture reaches near TDC on the compression stroke, the mixture is ignited by the spark plugs to cause the combustion. Thus, the power stroke commences. At this stage, the hot burnt gases push the rotor to further turn around, and expand until the leading lobe has cleared the exhaust port. The hot burnt gases begin to discharge from the chamber via the exhaust port and the exhaust stroke continues. Then the leading lobe has cleared the intake port again and the induction stroke restarts. In this manner, the four stages are repeatedly executed each revolution of the rotor. One example of the conventional Wankel engine has been disclosed in Japanese Utility Model Application Second Publication No. 64-15726.

However, it is very difficult to apply the basic construction of the Wankel engine as previously explained, to oil pumps used in pressure-feed lubricating systems of automotive engines, for the reasons described as follows.

In the Wankel engine, one meshing pair, namely, the stationary gear and the rotor internal gear, are provided for controlling the rotor in such a manner that the rotor eccentrically rotates around the drive shaft and follows the peri-trochoidal curved surface of the rotor housing. Such a conventional rotor-control device composed of the stationary gear and the rotor internal gear requires a high machining accuracy of the meshing pair. Further, the conventional rotor-control device has a complicated structure and many parts and therefore it also requires a relatively great installing space in the housing. Accordingly, if the conventional rotor-control device is used in a rotor-type pump, the high accuracy of machining of the meshing gears and the complicated structure cause reduction of operating efficiency in the producing process, leading to increase in production costs of the rotor-type pump. In addition, in the case of utilizing the conventional rotor-control device in the rotor-type pump, the relatively great space for installation of the meshing gears causes increase in the entire size and weight of the rotor-type pump.

Further, since the conventional rotor-control device guides the rotor in such a manner that the lobes of the rotor always slides on the peri-trochoidal curved surface, the lobes and the peri-trochoidal curved surface are subject to frictional abrasion caused due to the sliding contact therebetween for duration of time. This leads to reduction of the durability of the rotor and the peri-trochoidal curved surface. For this reason, the rotor and the peri-trochoidal curved surface must be covered with abrasion-resistant member or be in entirety made of suitable anti-abrasion materials. Therefore, in the case of using the conventional rotor-control device in the rotor-type pump, it results in increase in the production and material costs thereof.

Furthermore, in the Wankel engine, the fuel system mixes a fine spray of fuel with air to make a combustible and compressible air-fuel mixture and the compressible air-fuel mixture is compressed on compression stroke and ignited and expanded on power stroke. Namely, the Wankel engine is applied to a compressible fluid and so designed as to function as an internal combustion engine by way of compressing and expanding action of the compressible fluid, i.e., changes in volume in the combustion chamber. On the other hand, oil pumps are applied to incompressible fluid such as lubricating oil for automotive moving or rotating parts or working fluid for a power steering device.

SUMMARY OF THE INVENTION

It is an object of the present invention to provide a rotor-type pump having an increased performance and pumping efficiency.

It is another object of the present invention to provide a rotor-type pump capable of preventing frictional abrasion of a rotor and a trochoidal curved surface of a housing, serving for exhibiting an increased durability thereof.

It is still another object of the present invention to provide a rotor-type pump having a simple structure and a great volumetric capacity, serving for reducing the entire size and total weight of the rotor-type pump.

It is still another object of the present invention to provide a rotor-type pump with a simple rotor control mechanism for guiding a rotor along a trochoidal curved surface without using meshing gears which are mounted to a housing and the rotor, respectively.

According to one aspect of the present invention, there is provided a rotor-type pump including a housing having a trochoidal curved surface and an intake port and a discharge port. A drive shaft is mounted rotatably about a first axis in the housing. A rotor having a second axis eccentric to the first axis is rotatably mounted to the drive shaft and cooperates with the trochoidal curved surface. A plurality of working-fluid chambers are defined by the trochoidal curved surface and an outer peripheral surface of the rotor and variable in volume as the rotor rotates. The intake port is open into one chamber of the plurality of working-fluid chambers and the discharge port is open into another chamber thereof. A communication passage fluidly interconnects at least adjacent two of the plurality of working-fluid chambers. A rotor control mechanism is provided for controlling the rotor to move along the trochoidal curved surface with a predetermined clearance therebetween upon rotation of the rotor.

DESCRIPTION OF THE PREFERRED EMBODIMENT

Figure 1:
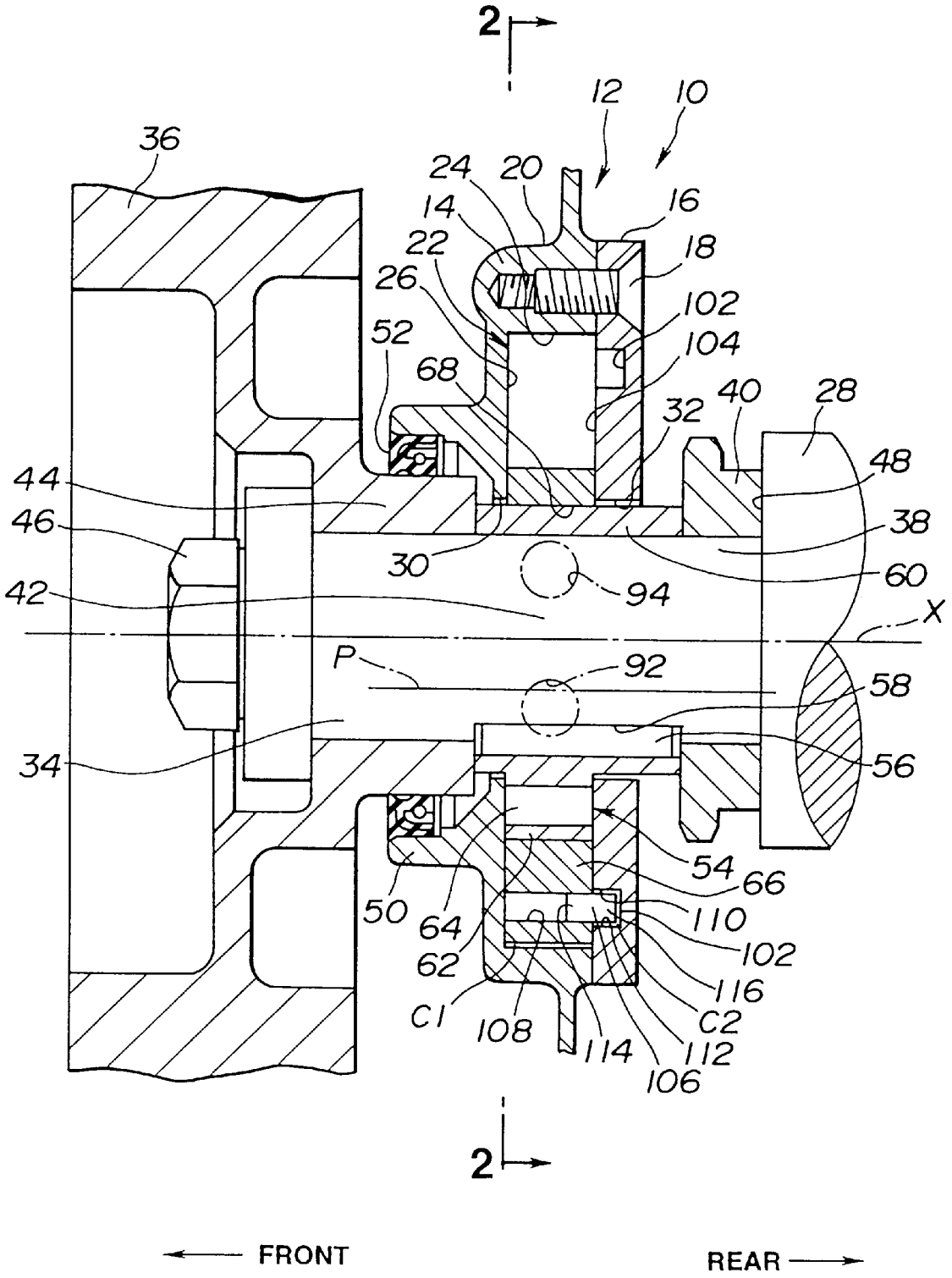
FIG. 1 is a cross-section, taken along an axis of a drive shaft, of a first embodiment of a rotor-type pump of according to the present invention.
Figure 2:
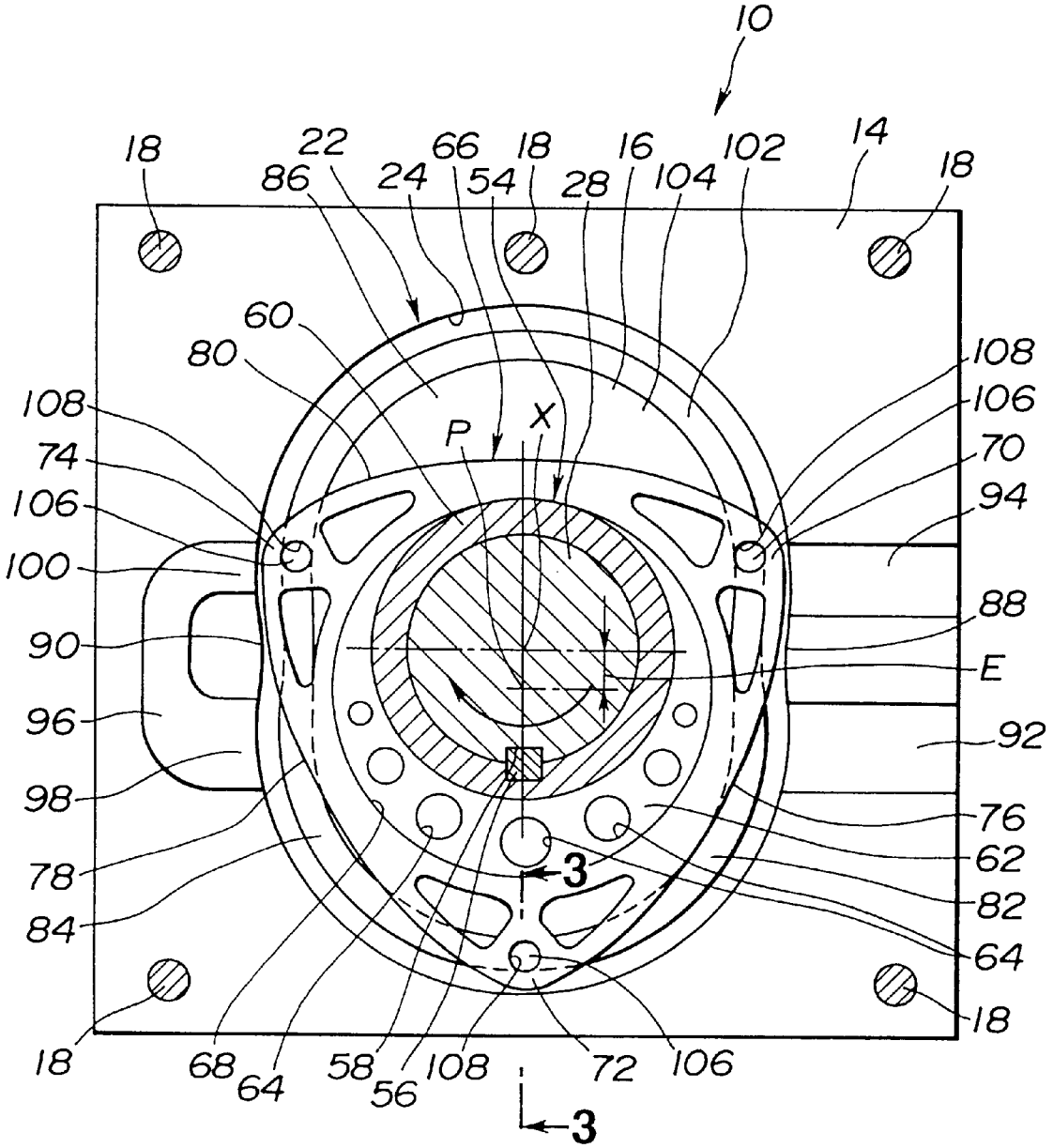
FIG. 2 is a cross-section taken along the line 2—2 of FIG. 1.

Referring now to FIGS. 1 and 2, the first embodiment of a rotor-type pump 10 according to the present invention is now explained.

As illustrated in FIG. 1, the rotor-type pump 10 includes a housing 12 composed of a housing body 14 having an open end, and a cover 16 hermetically closing the open end of the housing body 14 to define a cavity within the housing 12. The housing body 14 is secured to a stationary engine part such as a cylinder block (not shown). The housing body 14 is substantially rectangular in shape as shown in FIG. 2. The cover 16 similar in shape to the housing body 14 is positioned in place by a positioning pin, not shown, and secured to the open end of the housing body 14 by means of bolts such as flat-head bolts 18. The housing body 14 has a wall 20 defining a recessed portion 22 composed of a circumferentially extending endless-belt like curved surface 24 and a radially extending flat bottom surface 26. The circumferentially extending endless-belt like curved surface 24 is formed as a trochoidal curved surface.

A drive shaft 28 having a central axis X extends through a circular center bore 30 of the housing body 14 and a circular center bore 32 of the cover 16. The drive shaft 28 is connected to a crankshaft, not shown, of an internal combustion engine, not shown, and rotatable synchronously therewith. The drive shaft 28 includes a front end portion 34 connected with a drive pulley 36, a rear end portion 38 connected with a sprocket 40, and an intermediate portion 42 between the front end portion 34 and the rear end portion 38. The drive pulley 36 is formed with an axially rearward extending boss portion 44 fitted onto the front end portion 34 and is secured thereto by means of a bolt 46. The drive pulley 36 transmits a rotational force or driving torque to the drive shaft 28 through a timing belt, not shown. The sprocket 40 is fixed onto the rear end portion 38 in such a manner that one side face thereof abuts on a shoulder portion 48 of the rear end portion 38. Disposed on the boss portion 44 of the drive pulley 36 is a generally cylindrical oil seal housing 50 formed integrally with the housing body 14. An oil seal 52 is enclosed in the oil seal housing 50 to provide a tight seal between an outer periphery of the boss portion 44 and an inner periphery of the oil seal housing 50.

An eccentric rotor journal 54 is formed of a generally annular collar and fixed to the intermediate portion 42 of the drive shaft 28 by means of a key 56 fitted to an axially extending key way 58 formed at an outer periphery of the drive shaft 28. As seen from FIGS. 1 and 2, the eccentric rotor journal 54 has a cylindrical portion 60 which is fitted to the intermediate portion 42 of the drive shaft 28 and fixed thereto by the key 56 and the key way 58, and an eccentric flange portion 62 which is formed integrally with the cylindrical portion 60 and extends radially outwardly from an outer periphery of the cylindrical portion 60. The eccentric flange portion 62 has a central axis P radially eccentric to the central axis X of the drive shaft 28. As best shown in FIG. 2, the central axis P of the eccentric flange portion 62 is radially eccentric to the central axis X of the drive shaft 28 by a predetermined distance E. The eccentric flange portion 62 has a plurality of holes 64 arranged in circumferentially distant relation to each other for the purpose of lightening and weight balance. As illustrated in FIG. 1, the cylindrical portion 60 has one end portion, namely front end portion, extending outwardly through the center bore 30 of the housing body 14 and abutting against the boss portion 44 of the drive pulley 36. The cylindrical portion 60 has an opposite end portion, namely rear end portion, projecting outwardly from the center bore 32 of the cover 16 and abutting against a front side face of the sprocket 40. By the abutment, the eccentric rotor journal 54 is held in place to be prevented from its axial displacement on the drive shaft 28.

A rotor 66 is disposed within the cavity of the housing 12 and rotatably mounted to the eccentric rotor journal 54. The rotor 66 has a circular center bore 68 into which the eccentric flange portion 62 of the eccentric rotor journal 54 is fitted. The rotor 66 is coaxial with the eccentric flange portion 62 of the eccentric rotor journal 54. The rotational force is transmitted from the drive shaft 28 to the rotor 66 via the eccentric flange portion 62. The rotor 66 is so designed to be slightly smaller in axial length than the trochoidal curved surface 24 of the recessed portion 22 of the housing body 14. The rotor 66 is formed with a plurality of circumferentially equi-distantly spaced apexes or lobes on its outer peripheral surface. A plurality of working-fluid chambers are defined by the trochoidal curved surface 24 and the outer peripheral surface of the rotor 66, i.e., outer peripheral surface portions extending between respective adjacent two of the plurality of circumferentially equi-distantly spaced apexes. The working-fluid chambers are disposed adjacent to each other in the housing 12. The working-fluid chambers vary in volume as the rotor 66 rotates, as explained in detail later. The working-fluid chambers include at least one compression chamber decreasing in volume at a compression stage of the pump and at least one expansion chamber increasing in volume at an expansion stage thereof.

In this embodiment, as illustrated in FIG. 2, the rotor 66 has three apexes or lobes 70, 72 and 74 circumferentially equi-distantly spaced, and outer peripheral surface portions 76, 78 and 80 extending between the apexes 70, 72 and 74. In a case where the rotor 66 is placed in a position shown in FIG. 2, three working-fluid chambers 82, 84 and 86 are disposed between the trochoidal curved surface 24 and the rotor 66. Specifically, the working-fluid chamber 82 is defined by the outer peripheral surface portion 76 between the apexes 70 and 72 and the trochoidal curved surface 24. The working-fluid chamber 84 is defined by the outer peripheral surface portion 78 between the apexes 72 and 74 and the trochoidal curved surface 24. The working-fluid chamber 86 is defined by the outer peripheral surface portion 80 between the apexes 74 and 70 and the trochoidal curved surface 24. In a case where the rotor 66 rotates clockwise as indicated by the arrow in FIG. 2, and moves from the position shown in FIG. 2, the chamber 82 increases in volume, the chamber 84 decreases in volume, and the chamber 86 decreases in volume. The three apexes 70, 72 and 74 move along the trochoidal curved surface 24 of the housing body 14 to draw a peri-trochoidal curve, as the rotor 66 rotates.

As illustrated in FIG. 2, the trochoidal curved surface 24 of the housing body 14 has two inwardly convex portions 88 and 90 diametrically opposed to each other with respect to the central axis X of the drive shaft 28. The trochoidal curved surface 24 includes upper and lower arcuate parts as viewed in FIG. 2, with respect to the two convex portions 88 and 90. An intake port 92 and a discharge port 94 are disposed substantially parallel to each other on one side, right-hand side as viewed in FIG. 2, of the housing body 14. The intake port 92 is open into the lower arcuate part of the trochoidal curved surface 24 and the discharge port 94 is open into the upper arcuate part of the curved surface 24.

A substantially C-shaped fluid communication passage 96 is disposed on the other side, left-hand side as viewed in FIG. 2, of the housing body 14. The communication passage 96 has an inlet port 98 and an outlet port 100 which are disposed in opposed relation to the intake port 92 and the discharge port 94. The inlet port 98 is open into the lower arcuate part of the trochoidal curved surface 24 and the outlet port 100 is open into the upper arcuate part of the curved surface 24. The communication passage 96 is arranged such that, when the rotor 66 is in a position in which one of the apexes is opposed to the convex portion of the trochoidal curved surface 24 between the inlet port 98 and the outlet port 100, the communication passage 96 fluidly interconnects the adjacent two of the plurality of working-fluid chambers which are disposed on both sides of the one of the apexes.

Specifically, assuming that the rotor 66 is in a position retarded by approximately 30 degrees from a position shown in FIG. 2, in which the apex 74 is positioned opposed to the convex portion 90 of the trochoidal curved surface 24, the inlet port 98 and the outlet port 100 are open into the chamber 84 and the chamber 86 on both sides of the apex 74. Thus, the adjacent two chambers 84 and 86 are fluidly communicated via the communication passage 96.

The communication passage 96 varies in volume, resulting from changes in opening degree of the inlet port 98 and the outlet port 100 which are caused as the rotor 66 rotates. The communication passage 96 is so designed as to have a maximum volume of not less than a predetermined value which is obtained by subtracting a volume of one of the three working-fluid chambers which is in the course of decrease in volume when the rotor 66 is in the position shown in FIG. 2, from a volume of another chamber of the three working-fluid chambers which is the maximum at the end of the course of increase in volume when the rotor 66 is in same position or a position diametrically opposed thereto. Specifically, the one of the three working-fluid chambers is the chamber 84 shown in FIG. 2, and the another chamber is the chamber 86 or a chamber disposed between two of the three apexes 70, 72 and 74 which are substantially opposed to the intake port 92 and the inlet port 98 of the communication passage 96 when the remainder one of the apexes 70, 72 and 74 is opposed to the uppermost portion of the trochoidal curved surface 24. The chamber 84 further decreases in volume as the rotor further rotates clockwise. The decrement in volume of the chamber 84 is permitted by the arrangement of the communication passage 96.

The positional relationship between the apexes 70, 72 and 74 of the rotor 66 and the working-fluid chambers disposed therebetween will now be explained in detail as well as the fluid communication among the working-fluid chambers, the communication passage 96, and the intake and discharge ports 92 and 94.

When the rotor 66 is in the position shown in FIG. 2, the apex 70 begins to pass the discharge port 94 in such a manner to close the discharge port 94, the apex 72 is opposed to the lowermost portion of the trochoidal curved surface 24, and the apex 74 begins to clear the outlet port 100 of the communication passage 96 in such a manner to close the outlet port 100. In this position, the intake port 92 communicates with the chamber 82 and the inlet port 98 of the communication passage 96 communicates with the chamber 84. The fluid communication between the chambers 82 and 86 is blocked by the apex 70. The fluid communication between the chambers 82 and 84 is blocked by the apex 72 and the fluid communication between the chambers 84 and 86 via the communication passage 96 is blocked by the apex 74.

Assuming that the rotor 66 rotates clockwise to move from the position shown in FIG. 2 to an advanced position in which the apex 74 is opposed to the uppermost portion of the trochoidal curved surface 24, the apex 70 is substantially opposed to the intake port 92 to permit the fluid communication between the discharge port 94 and the chamber 86 and block the fluid communication between the intake port 92 and the chamber 82. In this position, the apex 72 is substantially opposed to the inlet port 98 to block the fluid communication between the communication passage 96 and the chamber 82. At the same time, the apex 74 blocks the fluid communication between the communication passage 96 and another working-fluid chamber newly disposed between the trochoidal curved surface 24 and the peripheral surface portion 78 between the apexes 72 and 74. During this movement of the rotor 66 from the position shown in FIG. 2 to the advanced position, the chamber 82 is in the course of increase in volume, the chamber 86 advances to the compression state decreasing in volume, and the chamber 84 is in the course of decrease in volume and then dissipates near the inlet port 98 while the new chamber is produced between the outer peripheral surface portion 78 between the apexes 72 and 74 and the upper-left part as viewed in FIG. 2, of the trochoidal curved surface 24.

When the rotor further rotates clockwise and moves from the above-described advanced position to a position where the apex 74 is immediately before the discharge port 94, the chamber 86 further decreases in volume and then dissipates near the discharge port 94 while another working-fluid chamber is newly produced between the lower-right part as viewed in FIG. 2, of the trochoidal curved surface 24 and the outer peripheral surface portion 80 between the apexes 70 and 74.

As will be appreciated, the intake stage and the discharge stage of the rotor-type pump of this embodiment are similar to the intake stroke and the exhaust stroke of the typical Wankel engine, respectively, while the compression stage and the expansion stage of the exemplified rotor-pump are considerably different from those of the Wankel engine. In case of the Wankel engine using a compressible air-fuel mixture, three chambers between rotor apexes are separated from each other by apex seals and thus a certain chamber in the compression stroke is completely separated from another chamber in the expansion stroke. On the other hand, in the rotor-type pump of the invention which uses an incompressible fluid, the chamber, e.g., the lower-left chamber 84 in FIG. 2, which is in the course of decrease in volume, is communicated with the chamber, e.g., the upper chamber 86 in FIG. 2, which is in the course of increase in volume, via the communication passage 96 for a predetermined time period from the time when the leading apex, e.g., the apex 74, has cleared the inlet port 98 to the time when the leading apex has cleared the outlet port 100. Thus, the communication passage 96 permits changes in volume of the two adjacent chambers which are in the course of decrease in volume and in the course of increase in volume, respectively.

Figure 3:
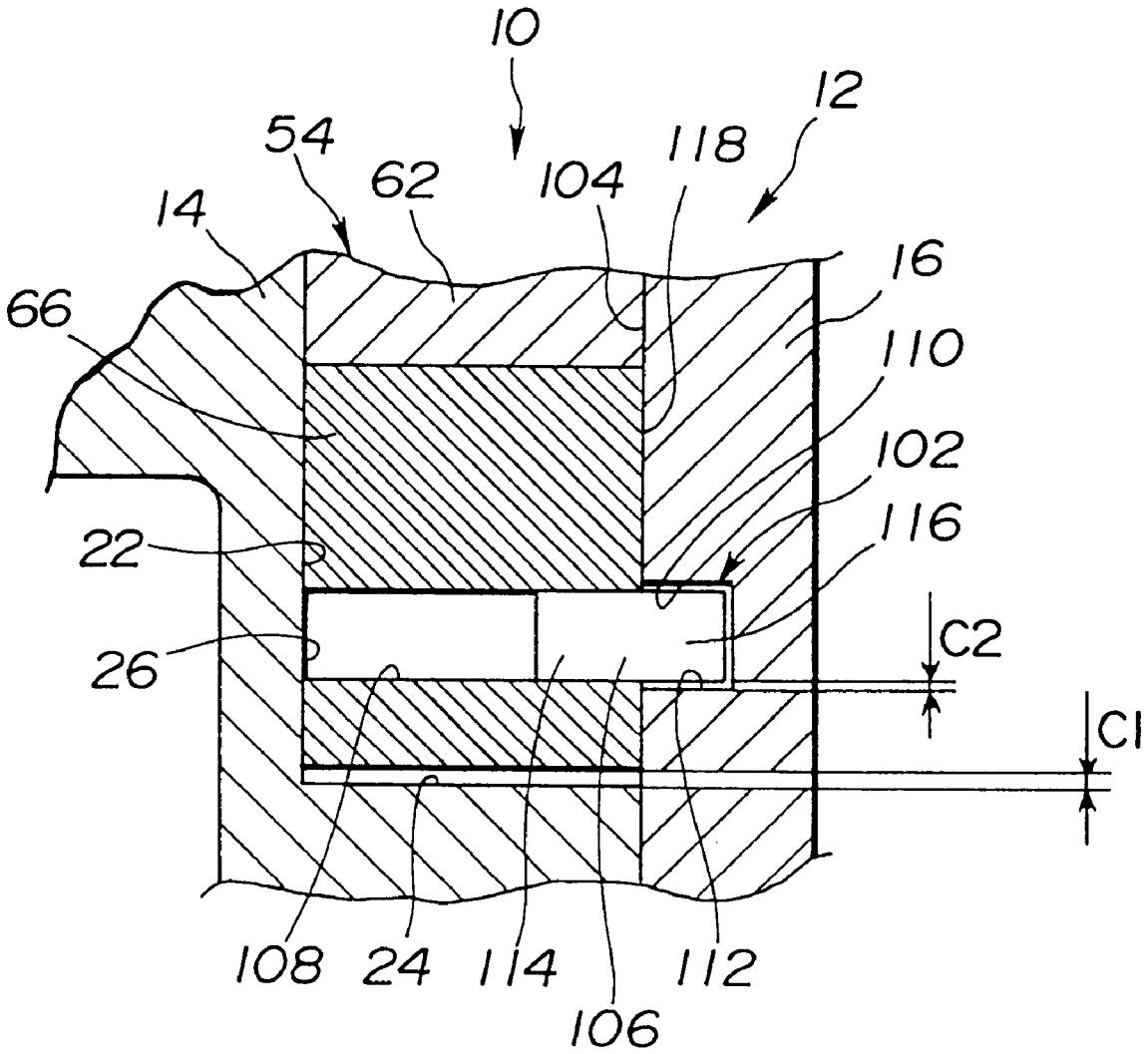
FIG. 3 is a fragmentary enlarged view of a part of FIG. 1.

A rotor control mechanism is provided for controlling the rotor 66 to move along the trochoidal curved surface 24 with a predetermined clearance C1 shown in FIG. 3, between the rotor 66 and the trochoidal curved surface 24 upon rotation of the rotor 66. Namely, the rotor control mechanism holds the rotor 66 in non-contact with the trochoidal curved surface 24 during rotation of the rotor 66.

The rotor control mechanism includes an endless guide groove 102 formed in an inside surface 104 of the cover 16 and a plurality of guide pins 106 secured to the rotor 66. The guide groove 102 is disposed radially inward the trochoidal curved surface 24 and precisely contoured along the trochoid curve of the curved surface 24, as best shown in FIG. 2. The guide groove 102 has a rectangular shape in cross-section as shown in FIG. 1. In this embodiment, three guide pins 106 parallel to each other are press-fitted to three pin-insertion holes 108 formed in the rotor 66. The pin-insertion holes 108 are arranged near the apexes 70, 72 and 74 such that a center axis of each guide pin 106 is located on a line segment extending between the apexes 70, 72 and 74 and the central axis P of the rotor 66. The pin-insertion holes 108 axially extend through the rotor 66 and oppose to the guide groove 102 of the cover 16. Each of the guide pins 106 is made of a suitable metal and formed into a cylindrical shape having an outer diameter smaller than a distance between two opposing radial inner and outer faces 110 and 112 shown in FIG. 3, of the guide groove 102.

Specifically, as illustrated in FIG. 3, the guide pin 106 has one flat end 114 tightly fitted into the pin-insertion hole 108 and an opposite flat end 116 projecting from one side face 118 of the rotor 66 and loosely fitted into the guide groove 102 with a radial clearance C2. The radial clearance C2 is formed between an outer periphery of the guide pin 106 and each of the radial inner and outer faces 110 and 112 of the guide groove 102. The radial clearance C2 is provided for smooth movement of the guide pins 106 in the guide groove 102 and serves for limiting a radial displacement of the rotor 66 upon rotation of the rotor 66.

Created between the trochoidal curved surface 24 and each of the apexes 70, 72 and 74 of the outer peripheral surface of the rotor 66 is the predetermined clearance C1. The predetermined clearance C1 is so designed as to be greater than the radial clearance C2 and smaller than a distance between the trochoidal curved surface 24 and each of the outer peripheral surface portions 76, 78 and 80 of the rotor 66. The predetermined clearance C1 is substantially uniform. The predetermined clearance C1 does not influence pumping efficiency by reason that the rotor-type pump of this embodiment is applied to incompressible viscous fluid such as lubricating oil for engine parts or working fluid for a power steering. The rotor control mechanism prevents the rotor 66 from being decelerated by the frictional contact of the apexes 70, 72 and 74 with the trochoidal curved surface 24 which is caused in a case where the rotor is adapted to slide on the trochoidal curved surface 24.

An operation of the rotor-type pump 10 of the first embodiment is explained hereinafter.

When the drive shaft 28 with the eccentric rotor journal 54 is rotated by way of the drive pulley 36, the rotational force or torque is transmitted through the outer peripheral surface of the eccentric flange portion 62 of the eccentric rotor journal 54 to the rotor 66. Following the three guide pins 106 smoothly sliding along the guide groove 102, the rotor 66 is smoothly and eccentrically rotated and moved along the trochoidal curved surface 24. As soon as one of the apexes, e.g., the apex 70 of FIG. 2, closes the discharge port 94 and working fluid or lubricating oil is sucked into the chamber, e.g., the chamber 82, fluidly communicated with the intake port 92. Then, the rotor 66 further rotates clockwise and moves from the position shown in FIG. 2 to the advanced position where the apex 72 approaches to the inlet port 98, the apex 70 has just cleared the intake port 92 and closes the intake port 92, and the apex 74 reaches the uppermost portion of the trochoidal curved surface 24. During the movement of the rotor 66, the chamber 84 between the apexes 72 and 74 decreases in volume and then dissipates while the chamber 82 between the apexes 70 and 72 increases in volume up to the maximum and another chamber is newly produced between the apexes 72 and 74. In the course of decrease in volume, the chamber 84 is communicated with the another chamber newly produced via the communication passage 96 with the inlet port 98 opened. In this compression state of the chamber 84, the outer peripheral surface portion 78 of the rotor 66 acts as a pressure applying surface which pushes out the working fluid from the chamber 84 to the adjacent chamber 86. Then, when the rotor 66 further rotates to move from the advanced position, the chamber 82 changes from the expansion state to the compression state, and at the same time, the another chamber newly produced continues to be expanded up to the maximum and the chamber 86 continues to be compressed and then dissipated. In the compression state, the chamber 86 is communicated with the discharge port 94 so that working fluid in the chamber 86 is pressurized by the outer peripheral surface portion 80 of the rotor 66 and forced out of the chamber 86 into the discharge port 94. In this manner, a series of pumping action can be achieved by the provision of the communication passage 96.

As compared with a prior art internal gear-type pump of the same size as the rotor-type pump 10 of the first embodiment, the rotor-type pump 10 of the first embodiment has the total volume of all the working-fluid chambers which is greater than that of the internal gear-type pump, resulting in a greater amount of discharged working-fluid per one revolution of the rotor. Accordingly, the rotor-type pump 10 can be designed to be smaller in size but have same pumping capacity as the prior art gear-type pump, serving for reducing the total weight of the rotor-type pump.

Further, the rotor-type pump 10 of the first embodiment has a simple construction, improving efficiency of production of the pump and saving the cost.

Furthermore, in the rotor-type pump 10 of the first embodiment, the rotor control mechanism composed of the guide groove 102 and the guide pins 106 is simplified in structure, contributing to reduction in the installation space and the number of components of the mechanism as well as increase in the production efficiency and thus cost-saving.

In addition, since the rotor control mechanism of the rotor-type pump 10 restrains the radial displacement of the rotor 66 upon rotation of the rotor 66, the rotor 66 is always held in non-contact with the trochoidal curved surface 24. Thus, the rotor 66 and the trochoidal curved surface 24 are prevented from frictional abrasion caused by a sliding contact therebetween. This results in a considerably increased durability of the rotor-type pump and nonuse of abrasion-resistant member mounted on the rotor 66 and/or the trochoidal curved surface 24 or anti-abrasion material suitable for producing in entirety the rotor 66 and/or the trochoidal curved surface 24.

Figure 4:
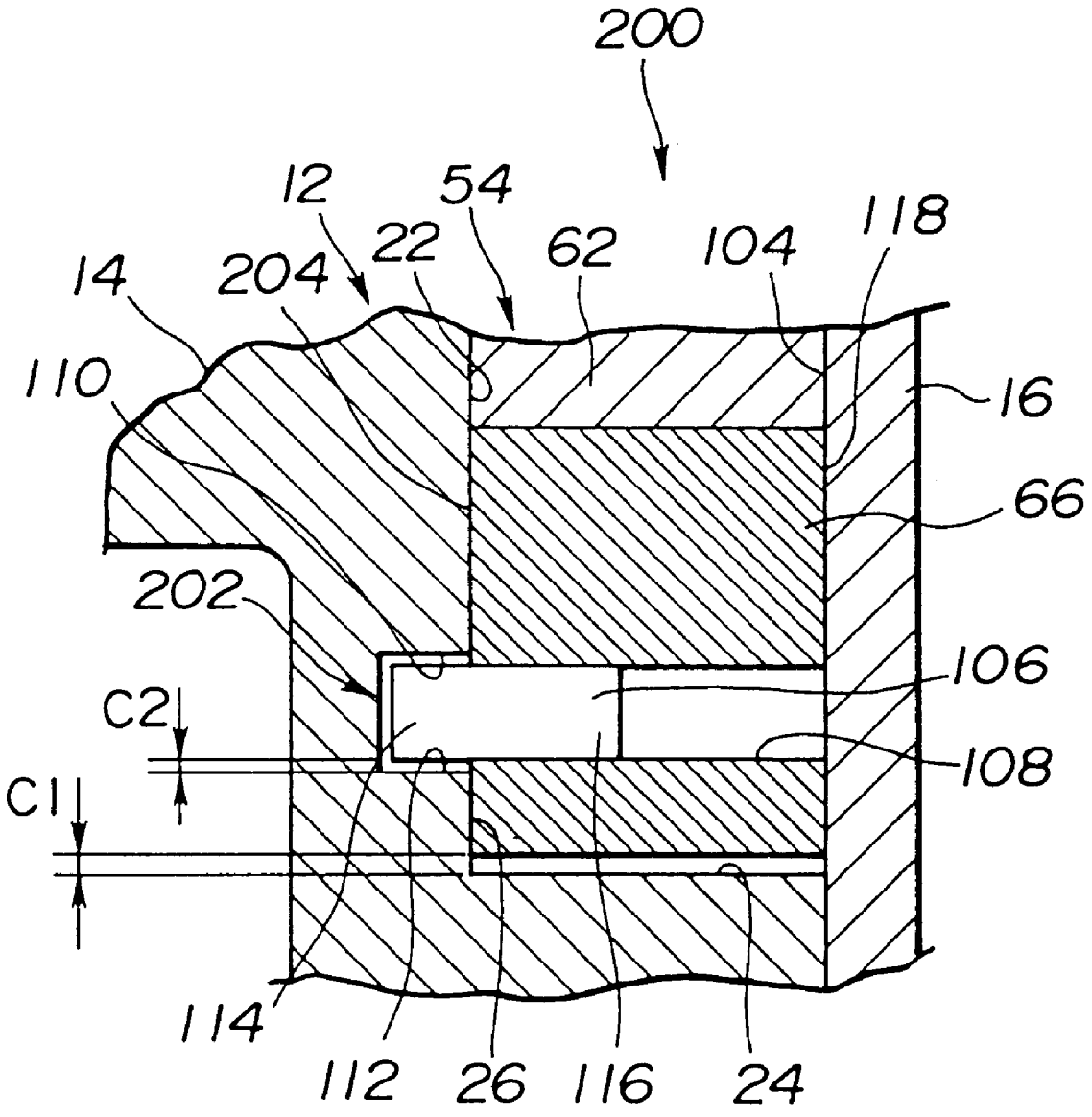
FIG. 4 is a fragmentary cross-section of a second embodiment of the rotor-type pump.

Referring to FIG. 4, the rotor-type pump 200 of the second embodiment is explained hereinafter, which is similar to the above-described first embodiment except the arrangement of the rotor control mechanism. Like reference numerals denote like parts and therefore detailed explanations therefor are omitted.

As illustrated in FIG. 4, the rotor control mechanism of the rotor-type pump 200 of the second embodiment includes an endless guide groove 202 formed in the flat bottom surface 26 of the recessed portion 22 of the housing body 14. The guide groove 202 is configured similar to the guide groove 102 of the first embodiment explained above. The guide pins 106 are fixed to the rotor 66 in such a manner that the flat end 114 projects from the other side surface 204 of the rotor 66 and loosely fitted to the guide groove 202. The second embodiment also performs same effects as those of the first embodiment as explained above.

Further, the rotor control mechanism of the rotor-type pump of the invention can be modified in such a manner that an endless guide groove is formed in either one of the opposite side faces of the rotor 66 near the apexes and a plurality of guide pins 106 are press-fitted into corresponding pin-insertion holes formed in the inside face of the cover 16 or the bottom surface 26 of the recessed portion 22 of the housing body 14. Similar to the first and second embodiments, there are provided a clearance between the guide pins 106 and the guide groove and a predetermined clearance which is greater than the clearance and disposed between the outer peripheral surface of the rotor 66 and the trochoidal curved surface 24.

Referring to FIGS. 5–14, the rotor-type pump 300 of the third embodiment is explained hereinafter, which is similar to the above-described first and second embodiments except the arrangement of the rotor control mechanism and the fluid communication passage. Like reference numerals denote like parts and therefore detailed explanations therefor are omitted.

Figure 5:
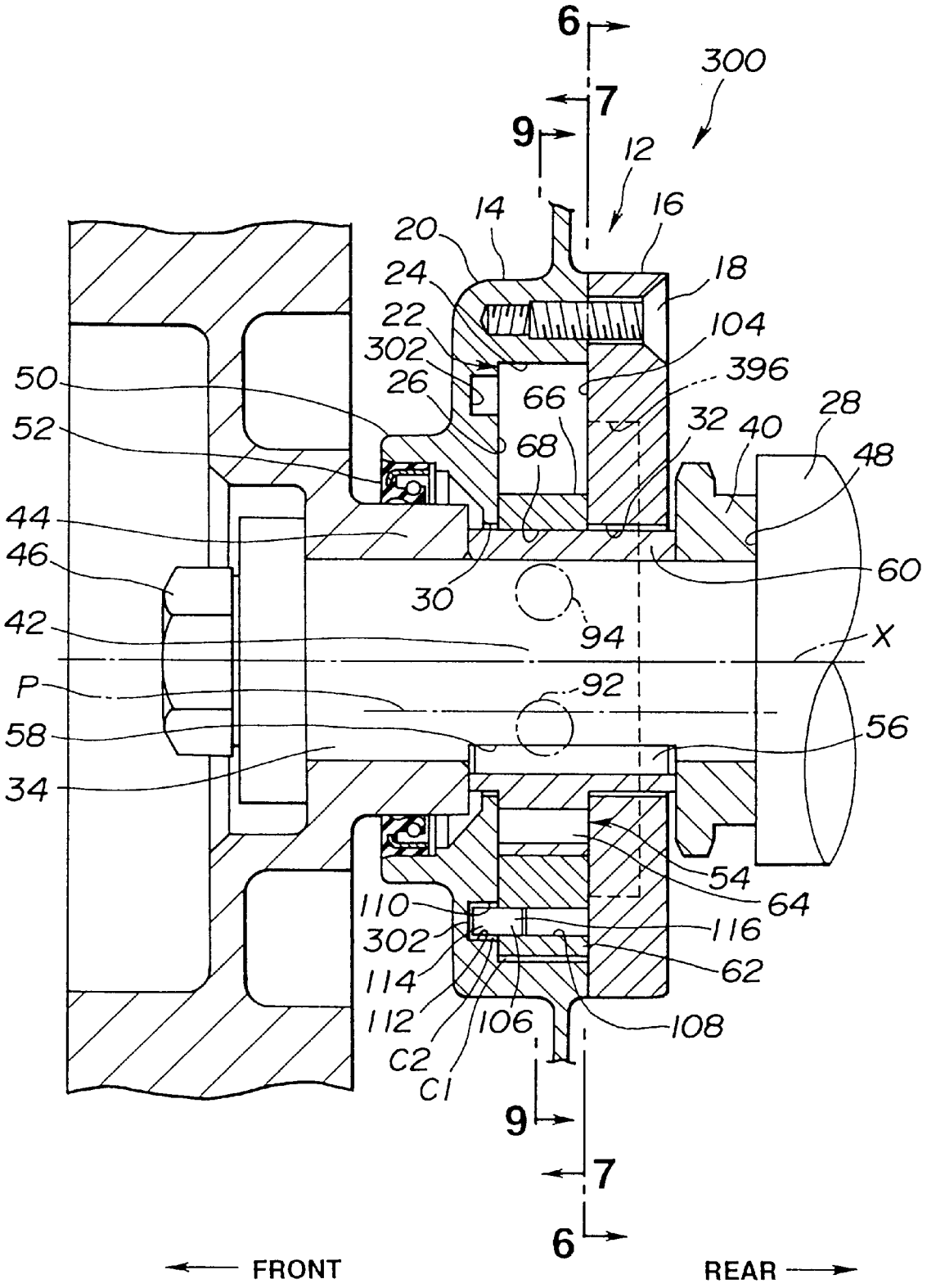
FIG. 5 is a cross-section, taken along an axis of a drive shaft, of a third embodiment of the rotor-type pump of the present invention.
Figure 7:
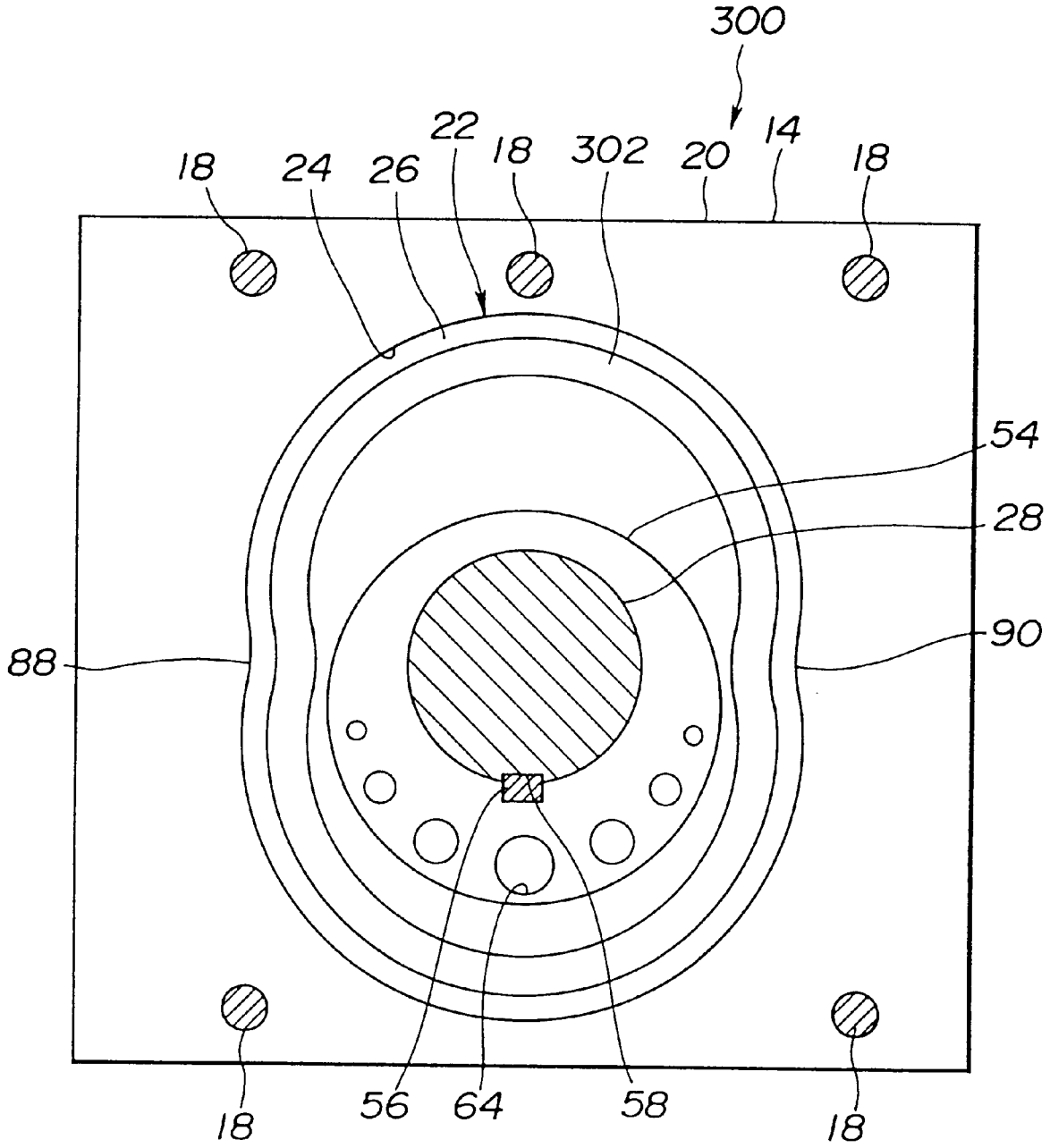
FIG. 7 is a cross-section taken along the line 7—7 of FIG. 5, but not showing a rotor.
Figure 8:
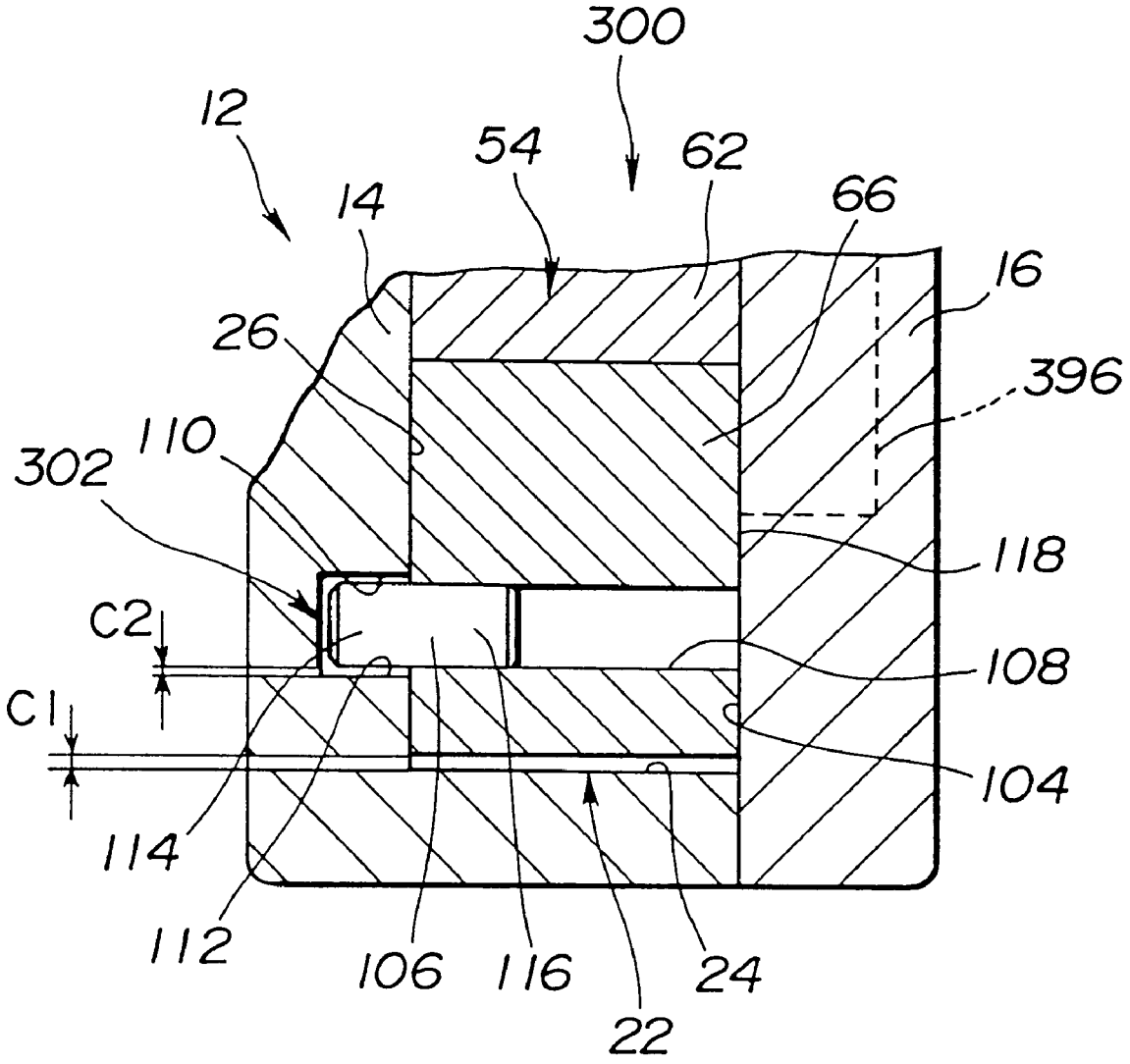
FIG. 8 is a fragmentary enlarged view of a part of FIG. 5.

As illustrated in FIGS. 5, 7 and 8, the rotor control mechanism of the rotor-type pump 300 includes an endless guide groove 302 contoured along the trochoidal curved surface 24 and formed in the bottom surface 26 of the recessed portion 22 of the housing body 14. Similar to the second embodiment, the guide pins 106 are loosely fitted to the guide groove 302 with the radial clearance C2 smaller than the predetermined clearance C1 between the outer peripheral surface of the rotor 66 and the trochoidal curved surface 24. This arrangement of the rotor control mechanism prevents the rotor 66 from being decelerated by sliding contact with the trochoidal curved surface 24 when the rotor 66 rotates, thus allowing the rotor to smoothly move along the trochoidal curved surface 24. This contributes to an improvement in performance of the rotor-type pump.

As illustrated in FIGS. 5, 6 and 9–14, the rotor-type pump 300 has a fluid communication passage 396 fluidly interconnecting at least adjacent two of the plurality of working-fluid chambers. The communication passage 396 is adapted to compensate a difference in pressure change between the adjacent two of the working-fluid chambers. One of the adjacent two of the working-fluid chambers is in the course of decrease in volume and the other thereof is in the course of increase in volume. The communication passage 396 has opposite inlet and outlet ports 398 and 400 which are contoured to be aligned with an outer perimeter of the rotor 66 when the rotor 66 is placed in a predetermined position where the communication passage 396 is fluidly disconnected from the intake and discharge ports 92 and 94 and fluidly interconnects adjacent two of the plurality of working-fluid chambers which are equal in volume to each other.

Figure 6:
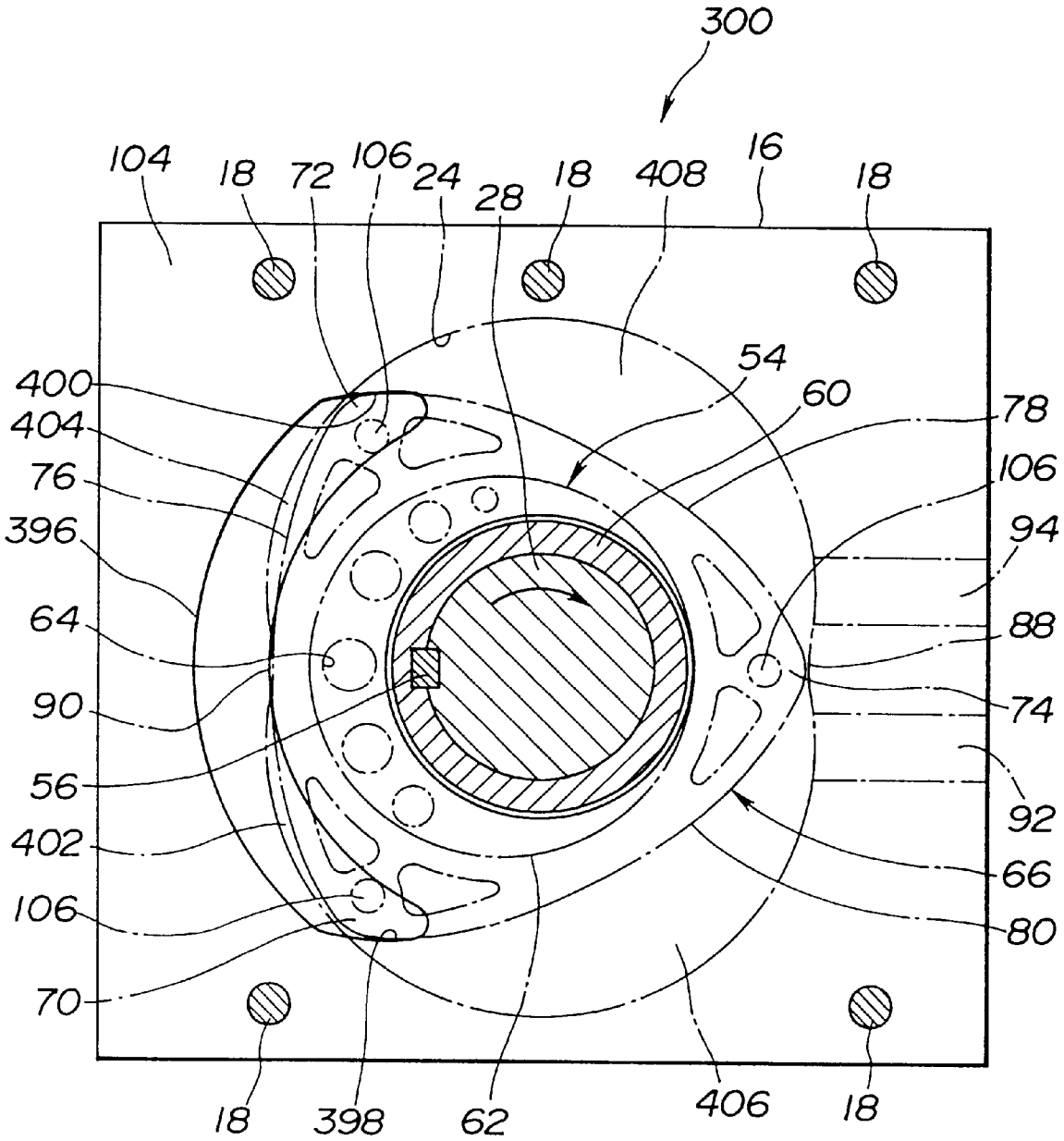
FIG. 6 is a cross-section taken along the line 6—6 of FIG. 5.
Figure 12:
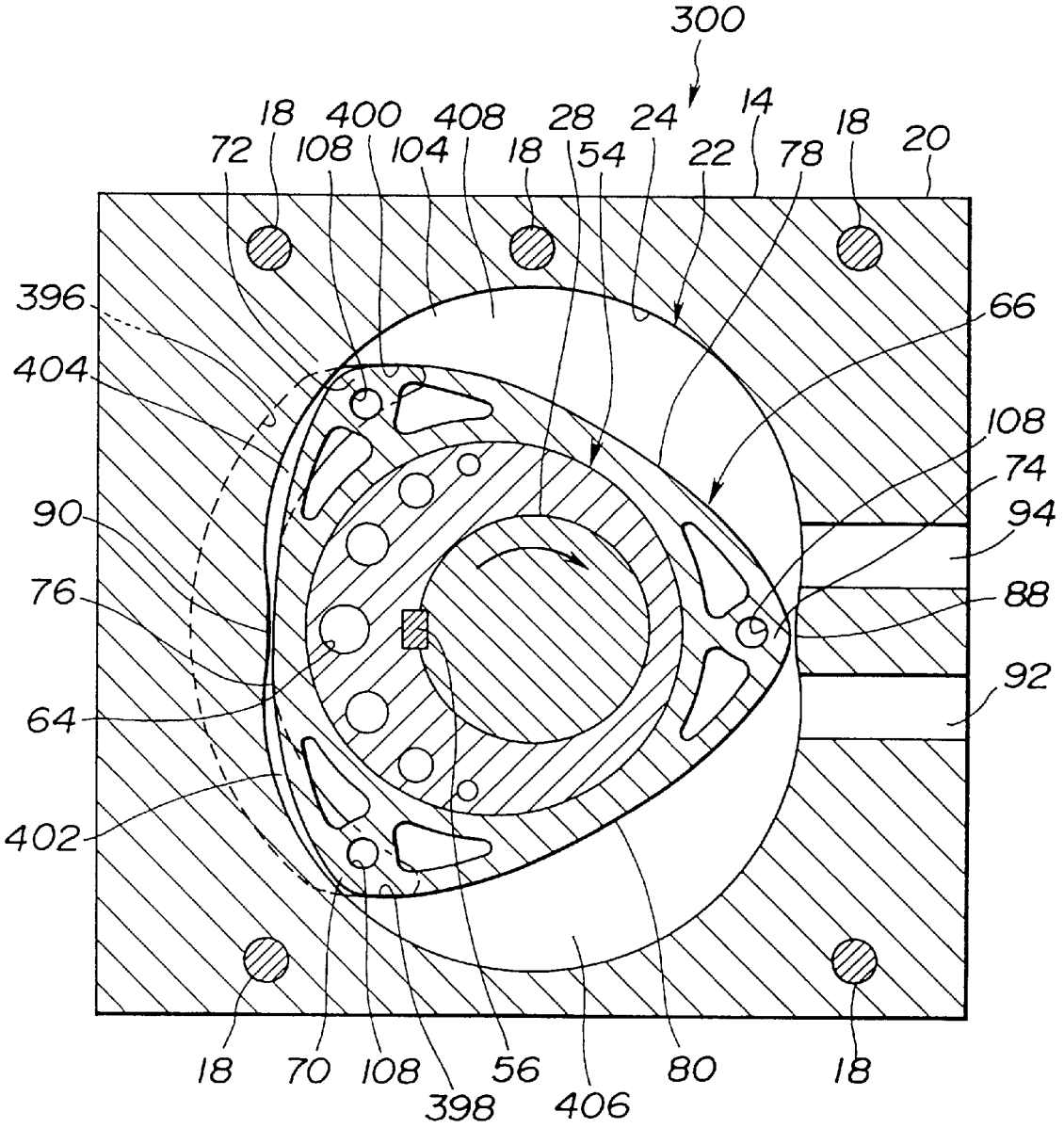

Specifically, the communication passage 396 is of a generally crescent shape shown in FIGS. 6 and 12 and formed in the cover 16 having a relatively greater thickness as shown in FIGS. 5. The inlet port 398 and the outlet port 400 of the communication passage 396 have peripheries which are aligned with the outer perimeter of the rotor 66 which constitute the outer peripheral surface portions 78 and 80, when the rotor 66 is placed in the predetermined position shown in FIGS. 6 and 12. Namely, the inlet port 398 is aligned with a part of the outer perimeter indicated at 80, of the rotor 66, and the outlet port 400 is aligned with a part of the outer perimeter indicated at 78, of the rotor 66. By this alignment, the communication passage 396 is fluidly disconnected from the intake port 92 and the discharge port 94. The communication passage 396 fluidly interconnects the adjacent two chambers 402 and 404 of four chambers produced in the housing 12. In the predetermined position of the rotor 66, the adjacent two chambers 402 and 404 are equal in volume to each other. The chamber 402 is in the course of decrease in volume, i.e., increase in pressure, while the chamber 404 is in the course of increase in volume, i.e., decrease in pressure.

On the other hand, in the predetermined position of the rotor 66, the remainder adjacent two chambers 406 and 408 are fluidly disconnected from the communication passage 396 and respectively fluidly connected to the intake port 92 and the discharge port 94. The remainder chambers 406 and 408 are also equal in volume to each other, and the chamber 406 is in the course of increase in volume, i.e., decrease in pressure while the chamber 408 is in the course of decrease in volume, i.e., increase in pressure.

The communication passage 396 extends along the adjacent two chambers 402 and 404 to communicate with each of the adjacent two chambers 402 and 404 on the same side of the housing body 14. In other words, the communication passage 396 is juxtaposed with the chambers 402 and 404 in the axial direction of the rotor 66. Further, the communication passage 396 of the generally crescent shape has radially spaced curved surfaces as best shown in FIG. 6, which extend along the outer perimeter of the rotor 66 as indicated at 76 in FIG. 6. The radially spaced curved surfaces are apart from each other by a substantially uniform distance.

Upon rotation, the rotor 66 takes a plurality of rotating positions including positions as illustrated in FIGS. 9 to 14, and the chambers are disposed within the housing 12 as explained in the above-described first embodiment. Referring now to FIGS. 9–14, a relationship between the chambers, the intake and discharge ports 92 and 94 and the communication passage 396 in the third embodiment will be explained hereinafter.

Figure 10:
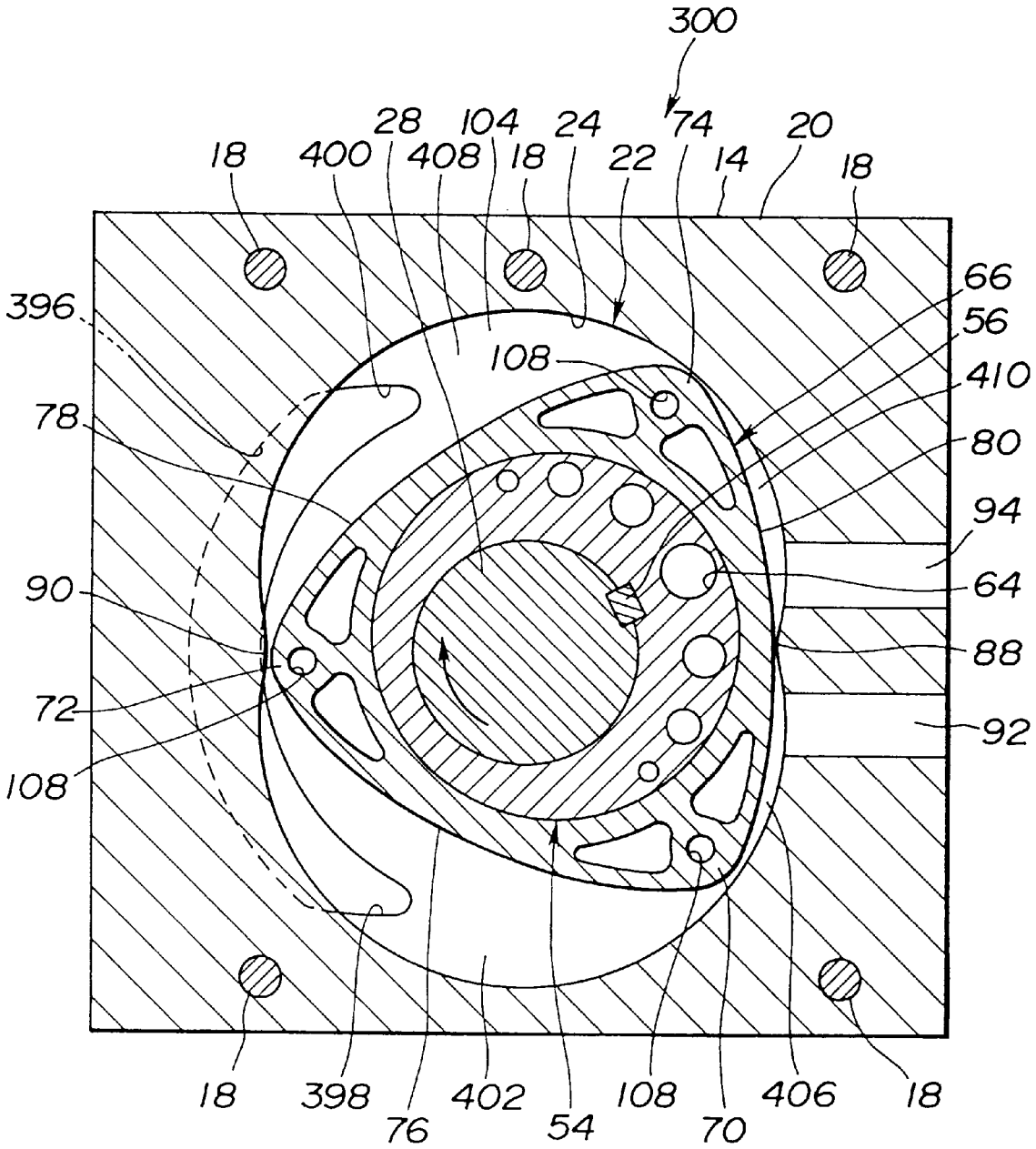
FIGS. 10–14 are cross-sections similar to FIG. 9 but illustrating the rotor disposed in other rotational positions.

First, assume that the rotor 66 is placed in the position shown in FIG. 10, which is substantially diametrically opposed to the predetermined position shown in FIG. 12. In this position of FIG. 10, the intake port 92 is open into the chamber 406 so that the expansion stage of the rotor-type pump 300 starts. At the same time, the discharge port 94 open into the chamber 410 is at the end of the course of decrease in volume and thus the compression stage of the rotor-type pump 300 terminates. The adjacent two chambers 402 and 408 opposed to the adjacent chambers 406 and 410 are fluidly interconnected through the communication passage 396 and fluidly disconnected to the intake port 92 and the discharge port 94. The inlet port 398 and the outlet port 400 of the communication passage 396 are uncovered or overlapped by the rotor 66 and open to the adjacent two chambers 402 and 408. In this position, each pair of the adjacent two chambers 406 and 410, and 402 and 408 are substantially equivalent in volume to each other.

Figure 9:
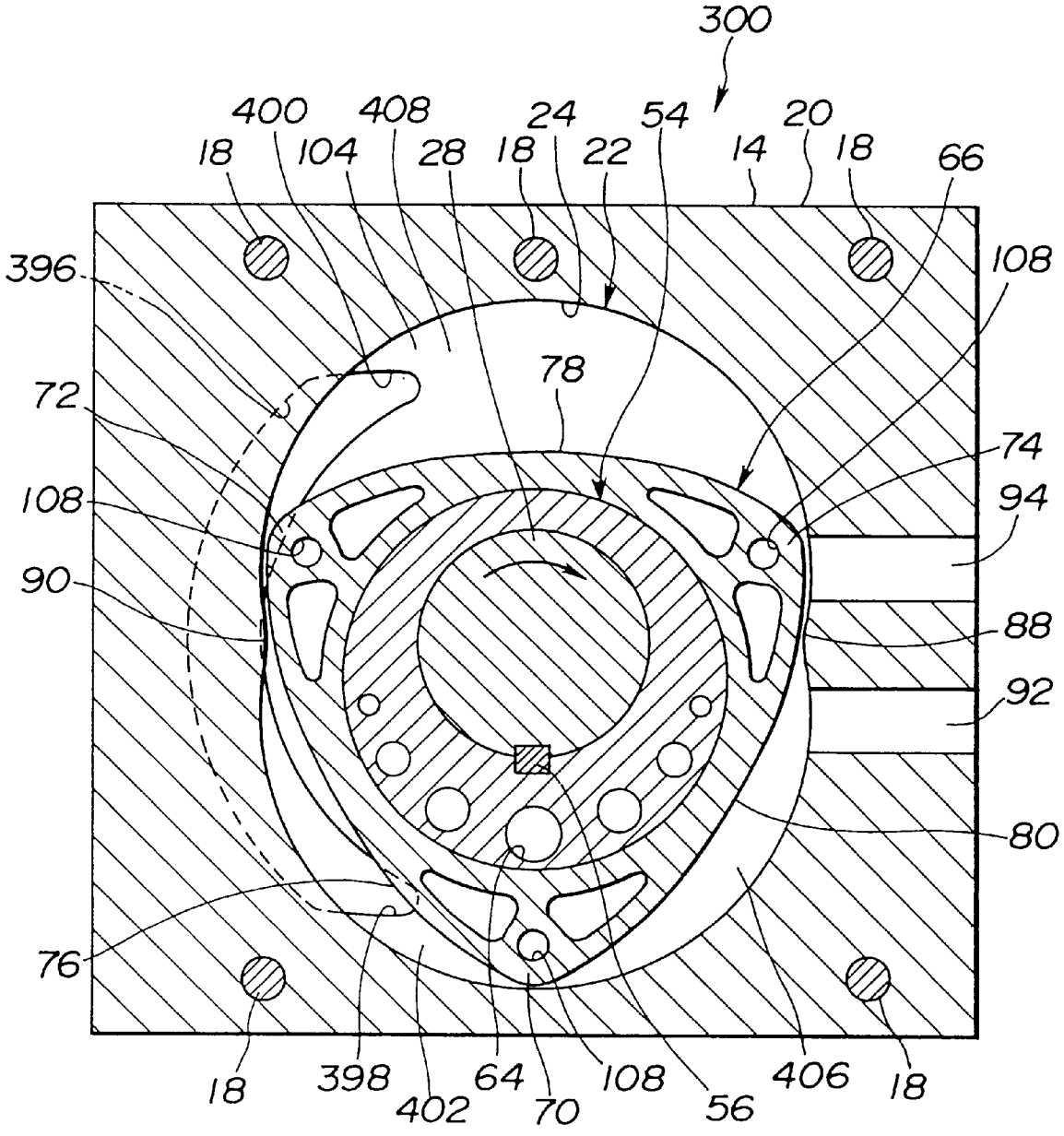
FIG. 9 is a cross-section taken along the line 9—9 of FIG. 5, showing the rotor disposed in a rotational position.

When the rotor 66 further rotates clockwise to move from the position shown in FIG. 10 to the position shown in FIG. 9, the chamber 406 connected to the intake port 92 increases in volume while the chamber 410 dissipates resulting from decrease in volume. The chamber 402 decreases in volume while the chamber 408 is the maximum in volume at the end of the course of increase in volume. The adjacent chambers 402 and 408 are still fluidly interconnected by the communication passage 396 and kept fluidly disconnected from the intake port 92 and the discharge port 94. The inlet port 398 and the outlet port 400 of the communication passage 396 are uncovered by the rotor 66 to be open to the chambers 402 and 408, respectively. The communication passage 396 is fluidly disconnected from the intake port 92 and the discharge port 94.

Figure 11:
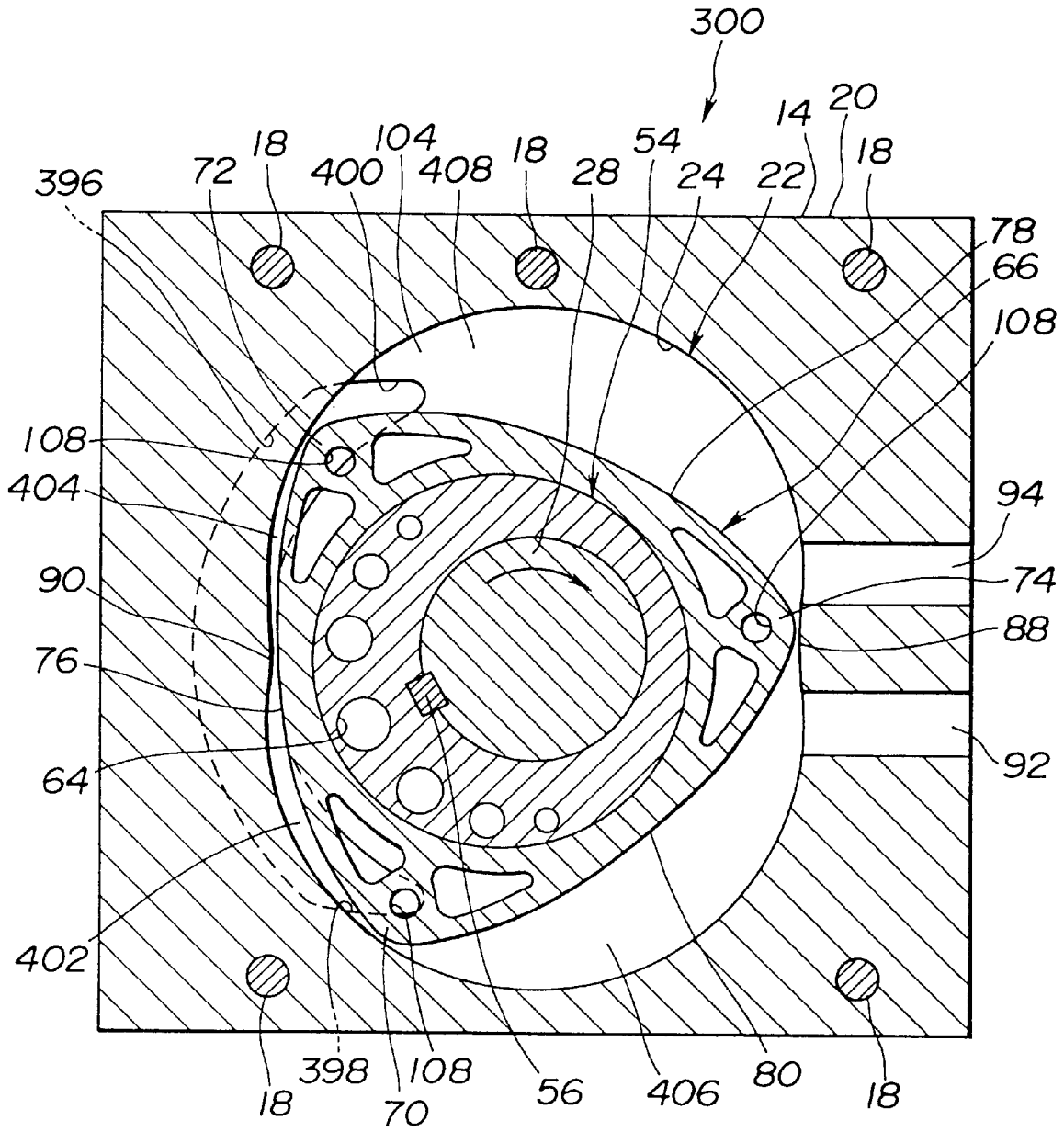

When the rotor 66 then reaches the position shown in FIG. 11, the chamber 406 connected to the intake port 92 is still in the course of increase in volume. The chamber 408 is brought into a fluid connection to the discharge port 94, decreasing in volume. Then, the compression stage of the rotor-type pump 300 starts. The chamber 402 is still in the course of decrease in volume. A chamber 404 is newly produced between the chambers 402 and 408 and subsequently begins to increase in volume. The inlet port 398 of the communication passage 396 is kept covered with the rotor 66 and the outlet port 400 thereof is uncovered with the rotor 66 to be open to the chamber 408. Thus, the communication passage 396 is fluidly disconnected from the intake port 92 but fluidly connected to the discharge port 94. The adjacent three chambers 402, 404 and 408 are fluidly interconnected by the communication passage 396 and fluidly connected to the discharge port 94 while being fluidly disconnected from the intake port 92. In this position as shown in FIG. 11, the decrease in volume in the chamber 402 is greater than the increase in volume in the chamber 404. Thus, there is a difference in volume change, i.e., pressure change, between the chamber 402 and the chamber 404. The difference is compensated by establishing the fluid communication from the chambers 402 and 404 to the chamber 408 connected to the discharge port 94.

Then, the rotor 66 further moves to the predetermined position shown in FIG. 12 as explained above. In this position, the adjacent chambers 402 and 404 which are in the course of decrease in volume and increase in volume, respectively, are equal in volume to each other and the inlet port 398 and the outlet port 400 of the communication passage 396 are aligned with and closed by the outer periphery 78 and 80 of the rotor 66. The chambers 402 and 404 are fluidly interconnected by the communication passage 396 and fluidly disconnected from the chamber 406 connected to the intake port 92 and the chamber 408 connected to the discharge port 94.

Figure 13:
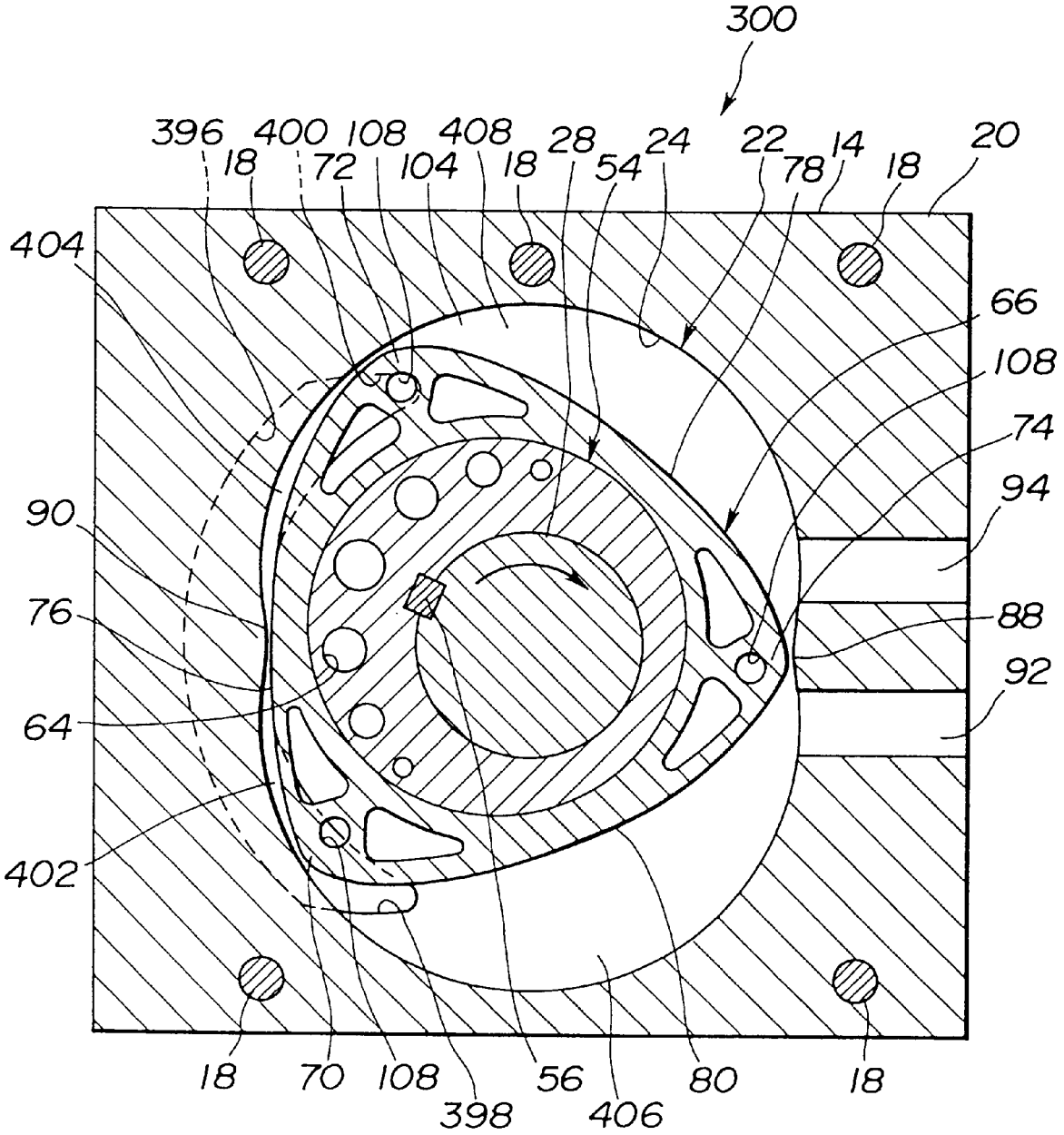

When the rotor 66 further moves to the position as shown in FIG. 13 displaced from the predetermined position shown in FIG. 12, the chamber 406 connected to the intake port 92 further increases in volume. The chamber 402 further decreases in volume while the chamber 404 newly produced increases in volume. The chamber 408 connected to the discharge port 94 is still in the course of decrease in volume. The outlet port 400 of the communication passage 396 is kept covered with the rotor 66 and the inlet port 398 thereof is uncovered with the rotor 66 to be open to the chamber 406. The communication passage 396 is fluidly connected to the intake port 92 but fluidly disconnected from the discharge port 94. The adjacent three chambers 406, 402 and 404 are fluidly interconnected by the communication passage 396 and fluidly connected to the intake port 92 while being fluidly disconnected from the discharge port 94. In this position as shown in FIG. 13, the decrease in volume in the chamber 402 is smaller than the increase in volume in the chamber 404. Thus, there is a difference in volume change, i.e., pressure change, between the chamber 402 and the chamber 404. The difference is compensated by establishing the fluid communication from the chamber 406 connected to the intake port 92, to the chambers 402 and 404.

Figure 14:
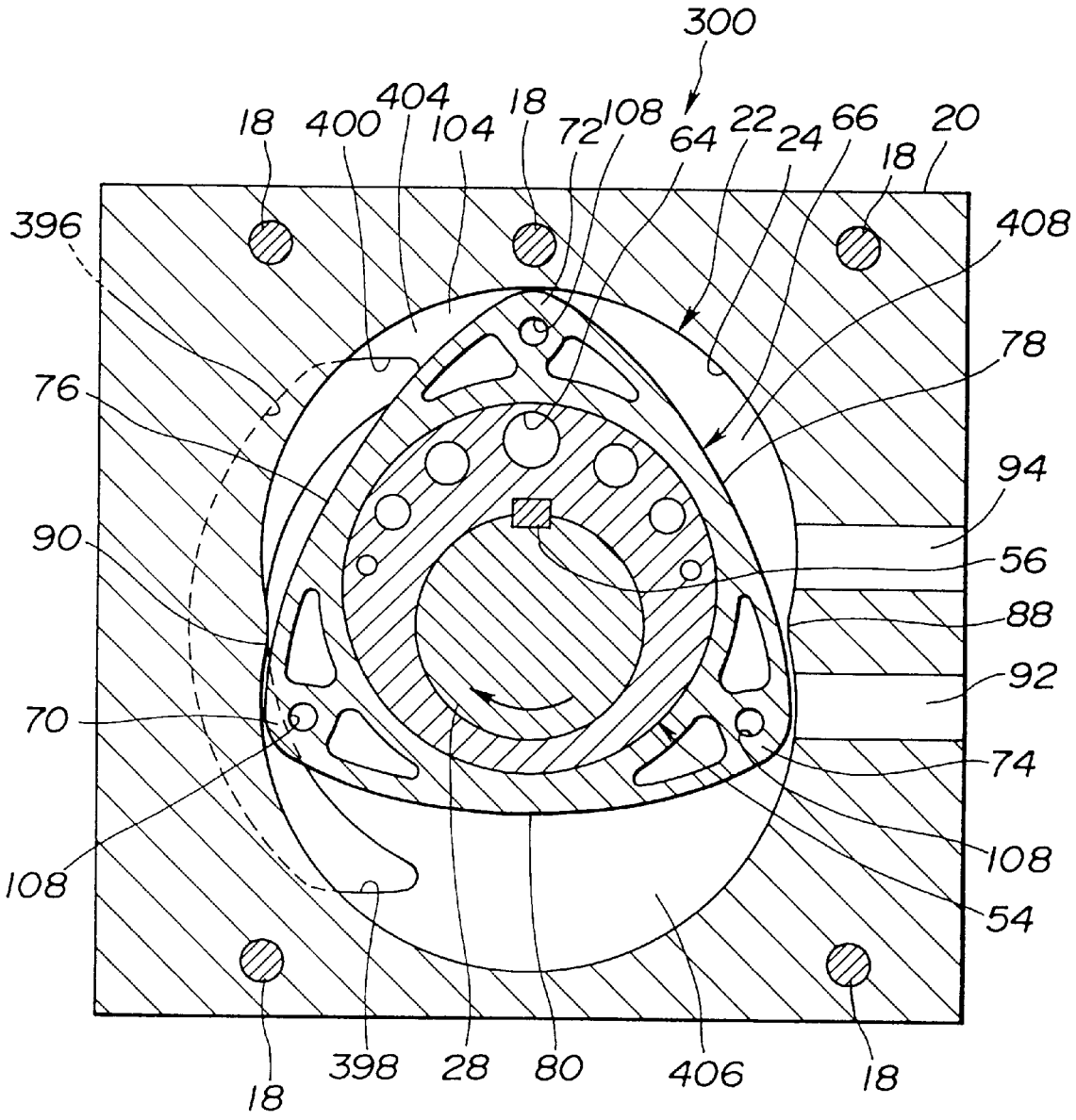

Further, the rotor 66 advances to the position shown in FIG. 14, which is substantially diametrically opposed to the position of FIG. 9. The chamber 406 is at the maximum in volume and fluidly disconnected from the intake port 92 and the chamber 402 has dissipated. The chamber 404 further increases in volume, and the chamber 408 further decrease in volume and fluidly connected to the discharge port 94. The inlet port 398 and the outlet port 400 of the communication passage 396 are uncovered with the rotor 66 to be open to the chambers 406 and 404, respectively. The chambers 406 and 404 are fluidly interconnected by the communication passage 396 and fluidly disconnected from the inlet port 92 and the discharge port 94. Thus, the communication passage 396 is fluidly disconnected from the intake port 92 and the discharge port 94.

Subsequently, as the rotor 66 further rotates, the chamber 408 comes into the end of the course of decrease in volume and then the compression stage of the rotor-type pump 300 terminates. At the same time, the chamber 406 begins to decrease in volume and a chamber is newly produced between the chamber 406 and the chamber 408. Thus, a series of the pumping actions of the rotor-type pump 300 is repeated.

As is appreciated from the above description, the communication passage 396 prevents the rotor 66 from being decelerated by the difference in pressure change, achieving smooth pumping actions of the rotor-type pump 300. This serves for improving a performance of the rotor-type pump. The third embodiment also performs same effects as those of the first embodiment as explained above.

In this third embodiment, the communication passage 396 is disposed in such a manner as to communicate with the adjacent chambers 402 and 404 over the entire area on the cover-side thereof when the rotor 66 is in the predetermined position. The communication passage 396 may be modified to communicate with the adjacent chambers 402 and 404 on at least a part of the cover-side area thereof when the rotor 66 is in the predetermined position. The communication passage 396 also may be formed of any other shape in which the opposite ports are so contoured as to be in alignment with the outer perimeter of the rotor 66 when the rotor 66 is in the predetermined position.

In addition, the communication passage 396 can be formed in the housing body 14, the guide groove 302 can be formed in the cover 16, and the guide pins 106 can be respectively disposed near the apexes 70, 72 and 74 of the rotor 66.

What is claimed is:

1. A rotor-type pump, comprising:

a housing having a trochoidal curved surface, lobes on the trochoidal curved surface, an intake port, and a discharge port;

a drive shaft mounted rotatably about a first axis in said housing;

a rotor having a plurality of circumferentially spaced apexes on an outer peripheral surface thereof, and a second axis eccentric to the first axis and rotatably mounted to said drive shaft, said rotor cooperating with the trochoidal curved surface;

a plurality of working-fluid chambers defined by said lobes on the trochoidal curved surface of said housing and said apexes on said outer peripheral surface of said rotor, said plurality of working-fluid chambers varying in volume as said rotor rotates;

said intake port communicating with one chamber of said plurality of working-fluid chambers and said discharge port communicating with another chamber thereof;

a communication passage in the housing fluidly interconnecting at least adjacent two of said plurality of working-fluid chambers; and a rotor control mechanism that controls said rotor to move along the trochoidal curved surface with a predetermined clearance therebetween upon rotation of said rotor, wherein said rotor control mechanism includes a guide groove contoured along the trochoidal curved surface and a plurality of rotor guide pins loosely fitted into the guide groove with a radial clearance that is smaller than said predetermined clearance.

2. A rotor-type pump as claimed in claim 1, wherein said communication passage is adapted to compensate a difference in pressure change between said plurality of working-fluid chambers.

3. A rotor-type pump as claimed in claim 1, wherein said predetermined clearance is provided between the trochoidal curved surface and each of said plurality of circumferentially spaced apexes on the outer peripheral surface of said rotor.

4. A rotor-type pump as claimed in claim 3, wherein said housing includes a housing body and a cover coupled with the housing body.

5. A rotor-type pump as claimed in claim 4, wherein said guide groove is formed in said cover and said plurality of guide pins are disposed near the apexes of said rotor.

6. A rotor-type pump as claimed in claim 4, wherein said guide groove is formed in said housing body and said plurality of guide pins are disposed near the apexes of said rotor.

7. A rotor-type pump as claimed in claim 4, wherein said communication passage is formed in said cover.

8. A rotor-type pump as claimed in claim 4, wherein said communication passage is formed in said housing body.

9. A rotor-type pump as claimed in claim 1, wherein said communication passage is disposed in said housing adjacent an outer perimeter of said rotor and has opposite ports that are contoured to be aligned with an outer perimeter of said rotor when said rotor is in a predetermined position, where said communication passage is fluidly disconnected from the intake and discharge ports and where adjacent two, which are equal in volume to each other, of said plurality of working-fluid chambers are fluidly interconnected.

10. A rotor-type pump as claimed in claim 9, wherein one of said adjacent two of said plurality of working-fluid chambers is in the course of increasing in volume and the other thereof is in the course of decreasing in volume when said rotor rotates.

11. A rotor-type pump as claimed in claim 9, wherein when said rotor is in said predetermined position, four working-fluid chambers are formed, among which two working-fluid chambers other than said adjacent two fluidly interconnected chambers are fluidly disconnected from said communication passage, and respectively fluidly connected to the intake and discharge ports, said two working-fluid chambers being equal in volume to each other, one of said two working-fluid chambers being in the course of increasing in volume and the other thereof being in the course of decreasing in volume when said rotor rotates.

12. A rotor-type pump as claimed in claim 9, wherein when said rotor is in a position displaced from said predetermined position, one of the opposite ports of said communication passage is uncovered by said rotor to permit a fluid communication between one of the intake and discharge ports and the adjacent two of said plurality of working-fluid chambers.

13. A rotor-type pump as claimed in claim 9, wherein when said rotor is in another position displaced from said predetermined position, the opposite ports of said communication passage are uncovered by said rotor, and said communication passage is fluidly disconnected from the intake and discharge ports, while adjacent two of said plurality of working-fluid chambers are fluidly interconnected.

14. A rotor-type pump as claimed in claim 9, wherein said communication passage extends along the adjacent two of the plurality of working-fluid chambers to communicate with each of said adjacent two of said plurality of working-fluid chambers on same side of said housing.

15. A rotor-type pump as claimed in claim 14, wherein said communication passage has radially spaced curved surfaces extending along the outer perimeter of said rotor, said radially spaced curved surfaces being apart from each other by a substantially uniform distance.

16. A rotor-type pump as claimed in claim 15, wherein said communication passage has a generally crescent shape.

17. A rotor-type pump, comprising:

a housing having a trochoidal curved surface, lobes on the trochoidal curved surface, an intake port, and a discharge port;

a drive shaft mounted rotatably about a first axis in the housing;

a rotor having a plurality of circumferentially spaced apexes on an outer peripheral surface thereof, and a second axis eccentric to the first axis and rotatably mounted to the drive shaft, the rotor cooperating with the trochoidal curved surface;

a plurality of working-fluid chambers defined by the lobes on the trochoidal curved surface of the housing and the apexes on the outer peripheral surface of the rotor, the plurality of working-fluid chambers varying in volume as the rotor rotates;

the intake port communicating with one chamber of the plurality of working-fluid chambers and the discharge port communicating with another chamber thereof;

a communication passage fluidly interconnecting at least adjacent two of the plurality of working-fluid chambers; and a rotor control mechanism that controls the rotor to move along the trochoidal curved surface with a predetermined clearance therebetween upon rotation of the rotor, wherein the communication passage is disposed in the housing adjacent to an outer perimeter of the rotor and has opposite ports that are contoured to be aligned with an outer perimeter of the rotor when the rotor is in a predetermined position, where the communication passage is fluidly disconnected from the intake and discharge ports, and where adjacent two, which are equal in volume to each other, of the plurality of working-fluid chambers are fluidly interconnected.

18. A rotor-type pump as claimed in claim 17, wherein one of the adjacent two of the plurality of working-fluid chambers is in the course of increasing in volume and the other thereof is in the course of decreasing in volume when the rotor rotates.

19. A rotor-type pump as claimed in claim 17, wherein when the rotor is in the predetermined position, four working-fluid chambers are formed, among which two working-fluid chambers other than the adjacent two fluidly interconnected chambers are fluidly disconnected from the communication passage, and respectively fluidly connected to the intake and discharge ports, the two working-fluid chambers being equal in volume to each other, one of the two working-fluid chambers being in the course of increasing in volume and the other thereof being in the course of decreasing in volume when the rotor rotates.

20. A rotor-type pump as claimed in claim 17, wherein when the rotor is in a position displaced from the predetermined position, one of the opposite ports of the communication passage is uncovered by the rotor to permit a fluid communication between one of the intake and discharge ports and the adjacent two of the plurality of working-fluid chambers.

21. A rotor-type pump as claimed in claim 17, wherein when the rotor is in another position displaced from the predetermined position, the opposite ports of the communication passage are uncovered by the rotor, and the communication passage is fluidly disconnected from the intake and discharge ports, while adjacent two of the plurality of working-fluid chambers are fluidly interconnected.

22. A rotor-type pump as claimed in claim 17, wherein the communication passage is adapted to compensate a difference in pressure change between the plurality of working-fluid chambers.

23. A rotor-type pump as claimed in claim 17, wherein the communication passage extends along the adjacent two of the plurality of working-fluid chambers to communicate with each of the adjacent two of the plurality of working-fluid chambers on same side of the housing.

24. A rotor-type pump as claimed in claim 23, wherein the communication passage has radially spaced curved surfaces extending along the outer perimeter of the rotor, the radially spaced curved surfaces being apart from each other by a substantially uniform distance.

25. A rotor-type pump as claimed in claim 24, wherein the communication passage has a generally crescent shape.

26. A rotor-type pump as claimed in claim 17, wherein the rotor control mechanism includes a guide groove contoured along the trochoidal curved surface and a plurality of rotor guide pins loosely fitted into the guide groove with a radial clearance.

27. A rotor-type pump as claimed in claim 26, wherein the predetermined clearance is greater than the radial clearance.

28. A rotor-type pump as claimed in claim 27, wherein the predetermined clearance is provided between the trochoidal curved surface and each of a plurality of circumferentially spaced apexes on the outer peripheral surface of the rotor.

29. A rotor-type pump as claimed in claim 28, wherein the housing includes a housing body and a cover coupled with the housing body.

30. A rotor-type pump as claimed in claim 29, wherein the guide groove is formed in the cover and the plurality of guide pins are disposed near the apexes of the rotor.

31. A rotor-type pump as claimed in claim 29, wherein the guide groove is formed in the housing body and the plurality of guide pins are disposed near the apexes of the rotor.

32. A rotor-type pump as claimed in claim 29, wherein the communication passage is formed in the cover, the guide groove is formed in the housing body, and the guide pins are disposed near the apexes of the rotor.

33. A rotor-type pump as claimed in claim 29, wherein the communication passage is formed in the housing body, the guide groove is formed in the cover, the plurality of guide pins are disposed near the apexes of the rotor.

* * * * *